US007458155B2

(12) United States Patent
Ricco et al.

(10) Patent No.: US 7,458,155 B2
(45) Date of Patent: Dec. 2, 2008

(54) METHOD OF PRODUCING A FUEL INJECTOR

(75) Inventors: Mario Ricco, Casamassima (IT); Adriano Gorgoglione, Modugno (IT)

(73) Assignee: C.R.F. Societa Consortile Per Azioni, Torino (IT)

( * ) Notice: Subject to any disclaimer, the term of this patent is extended or adjusted under 35 U.S.C. 154(b) by 505 days.

(21) Appl. No.: 10/974,446

(22) Filed: Oct. 27, 2004

(65) Prior Publication Data

US 2005/0087625 A1 Apr. 28, 2005

Related U.S. Application Data

(62) Division of application No. 10/034,631, filed on Dec. 28, 2001, now Pat. No. 6,824,082.

(30) Foreign Application Priority Data

Dec. 29, 2000 (IT) ..... TO2000A1230
Jan. 16, 2001 (IT) ..... TO2001A0025

(51) Int. Cl.
*B21K 1/20* (2006.01)
*F02M 39/00* (2006.01)

(52) U.S. Cl. ..... 29/890.124; 29/525; 239/533.3

(58) Field of Classification Search ..... 29/890.124, 29/525; 239/533.3, 533.2, 583, 584, 88, 239/96; 123/294, 527, 525, 529
See application file for complete search history.

(56) References Cited

U.S. PATENT DOCUMENTS 4,631,973 A 12/1986 Eley
4,635,853 A 1/1987 Mowbray
4,790,055 A 12/1988 Raufeisen et al.
4,938,193 A 7/1990 Raufeisen et al.
4,951,878 A * 8/1990 Casey et al. ..... 239/462
4,967,458 A * 11/1990 Rosenberg et al. ..... 29/888.011

FOREIGN PATENT DOCUMENTS

EP 0890729 1/1999

* cited by examiner

*Primary Examiner*—David P Bryant
*Assistant Examiner*—Sarang Afzali
(74) *Attorney, Agent, or Firm*—Ladas & Parry LLP

(57) ABSTRACT

A fuel injector has an injector body extending along a given axis; a tubular valve body housed inside a hole in the injector body and coaxial with the injector body; and an annular chamber defined by the injector body and the valve body. The method of producing the injector includes connecting the valve body to the injector body, and fixing the valve body in a given position along the axis with respect to the injector body by means of a driving operation to interference fit the valve body inside the hole in the injector body.

11 Claims, 2 Drawing Sheets

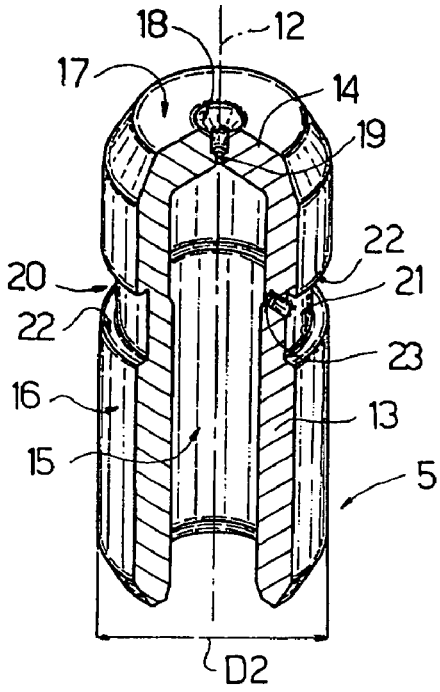
Fig.2
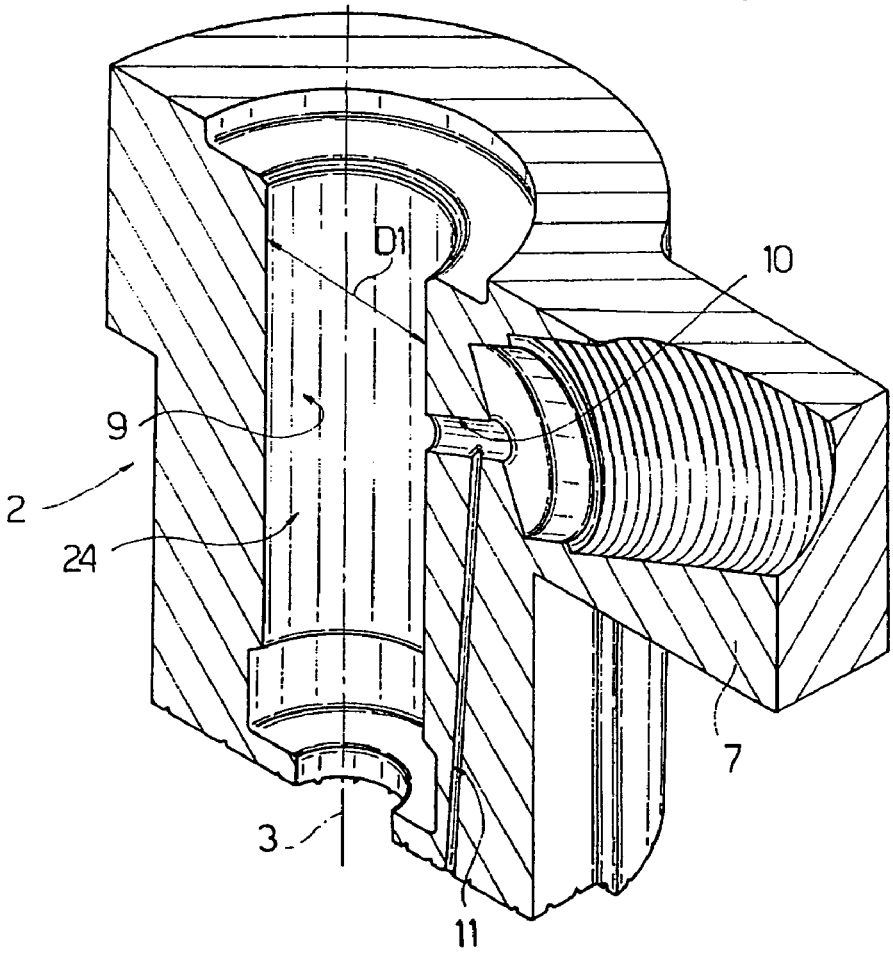

METHOD OF PRODUCING A FUEL INJECTOR

This is a divisional of application Ser. No. 10/034,631 filed on Dec. 28, 2001, and now U.S. Pat. No. 6,824,082, claims the benefit thereof and incorporates the same by reference.

The present invention relates to a fuel injector.

More specifically, the present invention relates to a fuel injector for an internal combustion engine, to which the following description refers purely by way of example.

BACKGROUND OF THE INVENTION

A known internal combustion engine fuel injector comprises a tubular injector body extending along a given axis; and a valve housed in a seat in the injector body and comprising a tubular valve body fixed inside the injector body seat and coaxial with the injector body. The injector has an annular chamber defined by the injector body and the valve body, which have respective annular shoulders separated by a given distance equal to the height of the annular chamber.

To form the injector, the valve body is fixed to the injector body in a given position along the axis by means of further shoulders formed on the valve and injector bodies and resting against each other, and by means of a ring nut which engages a threaded portion of the injector body and pushes the valve body axially against the injector body to keep the further shoulders in contact with each other. The injector also comprises a seal housed inside the annular chamber to prevent the high-pressure fuel fed into the annular chamber from leaking between the injector body and the valve body.

The method of producing the above injector comprises forming shoulders on the injector body and valve body to form the annular chamber; threading a portion of the injector body; forming further shoulders on the valve body and injector body to define a given axial position of the valve body with respect to the injector body; and assembling a seal and ring nut.

SUMMARY OF THE INVENTION

It is an object of the present invention to provide a particularly fast method of producing an injector.

According to the present invention, there is provided a method of producing a fuel injector comprising a tubular injector body extending along a given axis; a tubular valve body housed inside a seat in the injector body and coaxial with the injector body; and an annular chamber defined by the injector body and the valve body; the method comprising connecting the valve body to the injector body, and fixing the valve body to the injector body in a given position along the axis; and the method being characterized in that the valve body is connected and fixed to the injector body by means of a driving operation to interference fit the valve body inside the seat in the injector body.

Interference fitting the valve body inside the seat in the injector body enables the valve body to be fixed in a given axial position with respect to the injector body without machining further shoulders or the thread, and with no need for a ring nut, and also ensures hermetic sealing between the valve body and the injector body, so that the seal inside the annular chamber, between the valve body and the injector body, for sealing the annular chamber can be dispensed with.

Eliminating machining and reducing the number of component parts of the injector enable the injector to be produced extremely quickly.

In one particular embodiment, the method comprises forming an annular groove on said valve body; said groove interrupting the outer cylindrical face of the valve body and defining said annular chamber together with the inner face of said seat.

The size of the annular chamber is defined solely by formation of the groove, and does not depend on the axial position of the valve body with respect to the injector body; and the forces generated by the fuel pressure are balanced along said given axis, unlike known injectors in which the axial forces are not balanced and any loosening of the ring nut alters the size of the annular chamber.

The present invention also relates to an injector.

According to the present invention, there is provided an injector comprising a tubular injector body extending along a given axis; a tubular valve body housed inside a seat in the injector body and coaxial with the injector body; and an annular chamber defined by the injector body and the valve body; the injector being characterized in that the valve body is fixed to the injector body by means of a driving operation to interference fit the valve body inside the seat in the injector body.

BRIEF DESCRIPTION OF THE DRAWINGS

A non-limiting embodiment of the present invention will be described by way of example with reference to the accompanying drawings, in which:

FIG. 2 shows an exploded view, with parts in section and parts removed for clarity, of two component parts of the FIG. 1 injector.

DETAILED DESCRIPTION OF THE INVENTION

Figure 1:
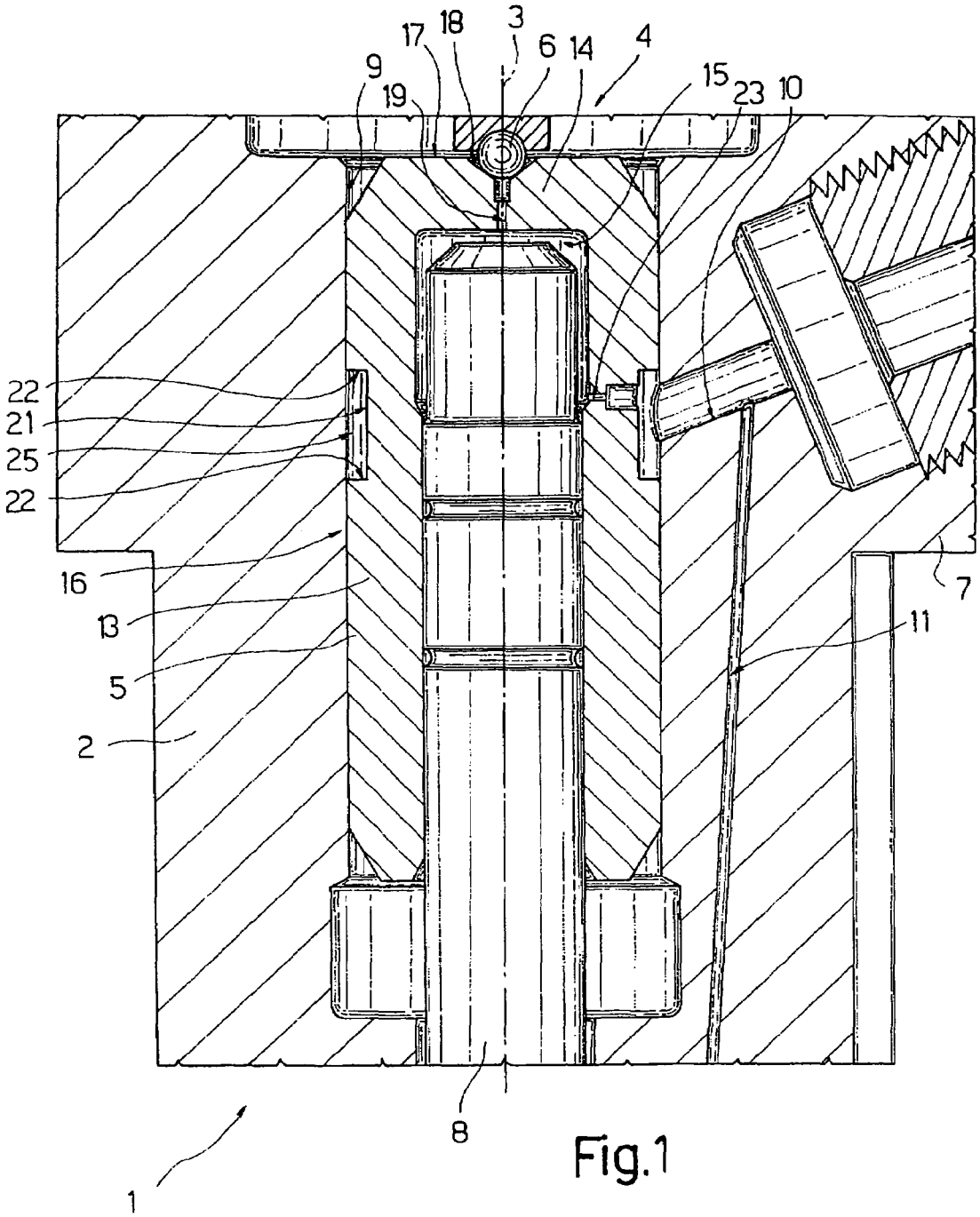
FIG. 1 shows a section, with parts removed for clarity, of an injector produced using the method according to the present invention.

Number 1 in FIG. 1 indicates as a whole a fuel injector for internal combustion engines.

Injector 1 comprises a tubular injector body 2 having an axis 3; and a valve 4 in turn comprising a valve body 5 fixed inside a seat in injector body 2, and a shutter 6. Hereinafter, both the axis of injector 2 and the axis of injector 1, being coincident, are referred to as axis 3. Injector 1 has a fitting 7 for connecting injector 1 to a high-pressure fuel supply conduit (not shown in FIG. 1); and a rod 8 sliding inside valve body 5. With reference to FIG. 2, injector body 2 comprises a hole 9 coaxial with axis 3, of a diameter D1, and defining said seat for housing valve body 5; a hole 10 crosswise to axis 3 and connecting hole 9 to fitting 7; and a hole 11 extending inside injector body 2, alongside hole 9, from hole 10 to a nozzle (not shown) at one end of injector body 2, to feed high-pressure fuel to the nozzle.

With reference to FIG. 2, valve body 5 is tubular and has an axis 12, a cylindrical lateral wall 13, and an end wall 14 perpendicular to axis 12. Walls 13 and 14 define a substantially cylindrical seat 15 for housing one end of rod 8, as shown in FIG. 1. In FIG. 2, lateral wall 13 has a cylindrical outer face 16 of diameter D2, and end wall 14 has an annular outer face 17 about a truncated-cone-shaped seat 18 for housing shutter 6. Valve body 5 comprises a nozzle 19, which is formed through end wall 14, is coaxial with axis 12, and connects seat 15 to seat 18, which is also coaxial with axis 12.

Cylindrical wall 13 has an annular groove 20, which divides outer face 16 into two distinct portions, and which comprises a cylindrical face 21 parallel to outer face 16, and two facing annular faces 22 perpendicular to axis 12. Valve body 5 comprises a nozzle 23, which is formed in cylindrical wall 13, at groove 20, is perpendicular to axis 12, and connects groove 20 to seat 15.

Depending on the application of injector 1, diameter D2 ranges between 6 and 8 mm and is greater than diameter D1 by an interference value ranging between 10 and 20 microns.

Injector body 2 is formed by means of known machining operations, and hole 9 is ground to form an inner cylindrical face 24 of hole 9 with a tolerance ranging between +0 and +0.005 mm. In substantially the same way, valve body 5 is formed by means of known machining operations, and is ground along outer face 16 to obtain a cylindrical surface with a tolerance ranging between +0.015 and +0.020 mm.

Injector body 2 is then heated, and a respective valve body 5 simultaneously cooled, e.g. using liquid nitrogen. Once heated and cooled respectively, injector body 2 and respective valve body 5 are aligned along respective axes 3 and 12, and, by means of a known press (not shown), valve body 5 is driven inside hole 9 into a given position along axis 3 of injector body 2, as shown in FIG. 1. With valve body 5 in said given position, groove 20 is located at hole 10 and defines, with inner face 24 of hole 9, an annular chamber 25. In other words, annular chamber 25 is defined by cylindrical face 21 and annular faces 22 of groove 20, and by a portion of face 24 of hole 9. The interference fit between injector body 2 and valve body 5 prevents high-pressure fuel leakage from chamber 25 with no seals required between injector body 2 and valve body 5.

The interference fit described improves sealing and the working life of injector 1 as compared with known seals, which tend to be drawn between the valve body and injector body of known injectors when subjected to over a thousand-bar working pressure.

The invention claimed is:

1. In a method of producing a fuel injector, the improvements comprising:

providing a tubular injector body having an axial seat defined by a cylindrical inner face extending along a given axis;

providing a tubular valve body housed inside the axial seat in the injector body and coaxial with the injector body, the valve body having a cylindrical lateral wall defined by a cylindrical outer face and a substantially cylindrical seat, the cylindrical lateral wall having an annular groove dividing the cylindrical outer face into two distinct portions for contacting the inner face, the valve body being sealingly fixed to the injector body by an interference fit provided by contacting the two distinct portions of the cylindrical outer face with the cylindrical inner face; and providing an annular chamber defined by the injector body and the valve body within the interference fit for supplying the fuel from the tubular injector body into the tubular valve body.

2. A method as claimed in claim 1, further comprising providing said axial seat as a hole having the cylindrical inner face with a given first diameter; and the valve body with the cylindrical outer face with a given second diameter.

3. A method as claimed in claim 2, further comprising providing the interference between the second diameter and the first diameter at 10 to 20 microns.

4. A method as claimed in claim 3, further comprising defining said annular chamber by the annular groove and by a portion of the cylindrical inner face of the injector body.

5. A method as claimed in claim 4, further comprising providing said annular groove with a cylindrical first face parallel to the cylindrical outer face of the valve body and two annular second faces on opposite sides of the cylindrical first face.

6. A method as claimed in claim 5, further comprising providing each annular second face perpendicular to said given axis, and extending from the cylindrical first face of the annular groove to the cylindrical inner face of the injector body.

7. A method as claimed in claim 2, further comprising grinding the cylindrical inner face and the cylindrical outer face of the valve body.

8. In a method of producing a fuel injector comprising a tubular injector body provided with an axial seat defined by a cylindrical inner surface extending along a given axis, and a tubular valve body housed inside the axial seat, the injector body being formed with a hole crosswise to the axis and communicating with a high-pressure fuel supply conduit, the valve body having a cylindrical lateral wall defined by an outer cylindrical surface and a substantially cylindrical seat, the cylindrical lateral wall having an annular groove dividing the outer cylindrical surface into two distinct portions for contacting the inner surface and communicating with the substantially cylindrical seat with a nozzle; the improvements of the method comprising:

grinding the inner surface at a first diameter;

grinding the outer cylindrical surface at a second diameter greater than the first diameter so as to have a predetermined fitting interference with the inner surface;

heating the injector body and simultaneously cooling the valve body;

mutually aligning the lateral wall with the axial seat so as to become coaxial; and driving the cooled valve body inside the axial seat of the heated injector body to a predetermined axial position with the groove facing the hole, wherein the annular groove defines with the inner surface an annular chamber defined by the injector body and the valve body, whereby to provide at a normal temperature by contacting the two distinct portions of the outer surface with the cylindrical inner surface an interference fit between the valve body and the injector body that prevents high-pressure fuel leakage from the annular groove.

9. A method as claimed in claim 8, wherein the heating of the injector body and cooling of the valve body being at least so just before the driving so as to be effective therein.

10. A method as claimed in claim 9, wherein the cooling of the valve body is with liquid nitrogen.

11. A method as claimed in claim 8, wherein said driving is performed with an interference of 10 to 20 microns between the second diameter and the first diameter.

* * * * *